US010582283B1

(12) United States Patent
Yin et al.

(10) Patent No.: US 10,582,283 B1
(45) Date of Patent: Mar. 3, 2020

(54) MULTIFUNCTIONAL LOUDSPEAKER DEVICE

(71) Applicants: Dongguan Voices Electronic Technology Co., Ltd., Guangdong (CN); New Times Global Limited, Kowloon (HK)

(72) Inventors: Hai Biao Yin, Guangdong (CN); Kai Tim Fung, Kowloon (HK)

( * ) Notice: Subject to any disclaimer, the term of this patent is extended or adjusted under 35 U.S.C. 154(b) by 0 days.

(21) Appl. No.: 16/413,593

(22) Filed: May 15, 2019

(30) Foreign Application Priority Data

Mar. 26, 2019 (CN) ..... 2019 1 0236506

(51) Int. Cl.

| | |
|---|---|
| ***H04R 31/00*** | (2006.01) |
| ***H04R 1/02*** | (2006.01) |
| ***F21V 33/00*** | (2006.01) |
| ***H04R 3/00*** | (2006.01) |
| *F21Y 115/10* | (2016.01) |

(52) U.S. Cl.
CPC ..... *H04R 1/025* (2013.01); *F21V 33/0056* (2013.01); *H04R 3/00* (2013.01); *H04R 31/006* (2013.01); *F21Y 2115/10* (2016.08); *H04R 2499/11* (2013.01)

(58) Field of Classification Search
CPC ..... H04R 1/44; H04R 1/026; H04R 1/025; H04R 31/006; H04R 2499/11; H04R 1/023; H04R 1/28; F21V 33/0056
USPC ..... 381/334, 386; 181/149, 179
See application file for complete search history.

(56) References Cited

U.S. PATENT DOCUMENTS 9,615,155 B2 * 4/2017 Yoshida ..... H04R 1/02

* cited by examiner

*Primary Examiner* — Paul Kim
*Assistant Examiner* — Ubachukwu A Odunukwe
(74) *Attorney, Agent, or Firm* — Prakash Nama; Global IP Services, PLLC

(57) ABSTRACT

A multifunctional loudspeaker device, having a shell, L-shaped mounting parts arranged at one end of the shell, a loudspeaker body on the L-shaped mounting parts, a back cover at the other end of the shell, a sealing rubber ring between the back cover and the shell, and a flexible plastic cushion sleeving the shell, the flexible plastic cushion is hollow and has a shape matching with the exterior of the shell, airbags are distributed in the flexible plastic cushion, an air-pressure probe is also arranged in the flexible plastic cushion. A layer of the flexible plastic cushion with high buffer coefficient is additionally arranged on the peripheral surface of the multifunctional loudspeaker device so that the shockproof performance of the device is improved.

8 Claims, 4 Drawing Sheets

MULTIFUNCTIONAL LOUDSPEAKER DEVICE

BACKGROUND OF THE INVENTION

The present disclosure relates to the technical field of loudspeakers, and specifically provides a multifunctional loudspeaker device.

Currently, the loudspeaker device on the market is usually externally provided with certain protective devices on the premise of not influencing the use experience in order to protect the loudspeaker device. Commonly solid rubber or high-hardness materials are used for fabricating certain products to reinforce the shell of the loudspeaker device, but these products have insufficient buffer coefficient so that their internal structures are easy to be damaged by shocking; moreover, these products have bad sealing performance so that their waterproof grade is relatively lower, and the functions are relatively more single, thereby bringing bad sensory experience to the customers.

BRIEF SUMMARY OF THE INVENTION

An objective of the present disclosure is to provide a multifunctional loudspeaker device in order to solve the above problems in the background.

In order to achieve the above objective, the present disclosure provides the following technical scheme: a multifunctional loudspeaker device comprises a shell, L-shaped mounting parts are arranged at one end of the shell, a loudspeaker body is arranged on the L-shaped mounting parts, a back cover is arranged at the other end of the shell, a sealing rubber ring is arranged between the back cover and the shell, double grooves are distributed on the outer side of the shell, a flexible plastic cushion sleeves the shell, the flexible plastic cushion is of a hollow structure and has a shape matching with the exterior of the shell, airbags with different sizes are distributed in the body of the flexible plastic cushion, air is full of the airbags, and an air-pressure probe is also arranged in the body of the flexible plastic cushion.

Preferably, an energy storage region is arranged in the shell, and a lithium battery is arranged in the energy storage region.

Preferably, a function button region and a jack are arranged on the outer side of the back cover, a sealing rubber plug is arranged in the jack, a circuit board is arranged on the inner side of the back cover, the circuit board is electrically connected with an LED lamp, the back cover is further provided with a balance switch, the balance switch is detachably mounted on a fixing fastener, and the balance switch is electrically connected with the circuit board.

Preferably, grooves are formed in the outer side of the flexible plastic cushion.

Preferably, a protecting net is laterally arranged on the loudspeaker body, and the protecting net is fixed on the shell.

Preferably, the back cover and the shell are mutually connected, and the sealing rubber ring is arranged on the back cover or the shell.

Preferably, the internal volume of the flexible plastic cushion is equal to or smaller than the volume of the shell.

Preferably, the flexible plastic cushion is made from an elastic material.

Compared with the prior art, the present disclosure has the beneficial effects: a layer of the flexible plastic cushion with high buffer coefficient is additionally arranged on the peripheral surface of the multifunctional loudspeaker device so that the shockproof performance of the device is improved; due to a combination of the flexible plastic cushion and the sealing rubber ring, the device may reach the fifth waterproof grade and can float on the water; and when the device falls off, is impacted or is extruded, a signal is transmitted through the balance switch according to response of the air-pressure probe, and then the loudspeaker body may emit a preset sound and emit lights of different modes at the same time.

DETAILED DESCRIPTION OF THE INVENTION

The following clearly and completely describes the technical schemes in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

Figure 1:
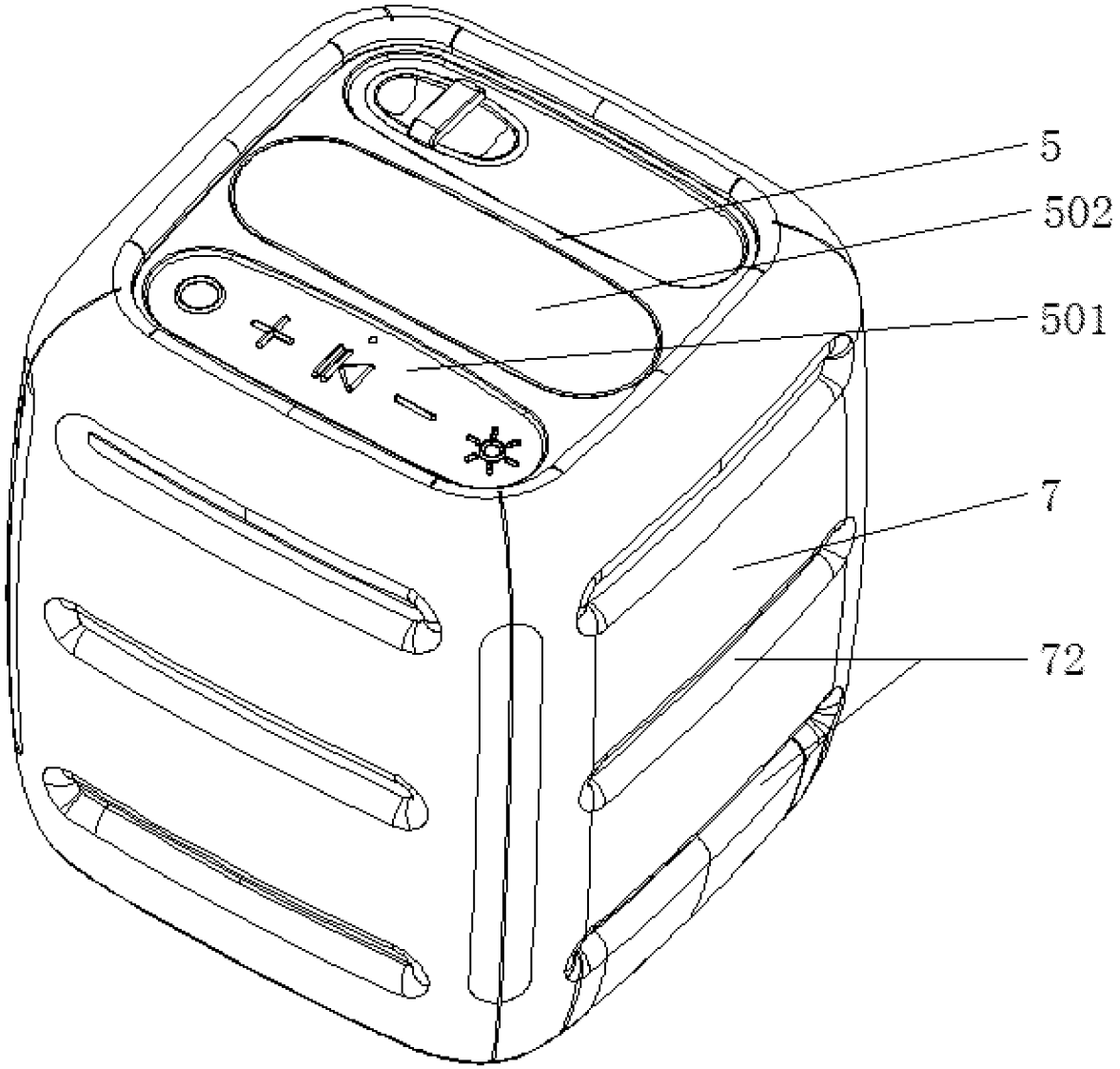
FIG. 1 is a stereogram of the present disclosure.
Figure 2:
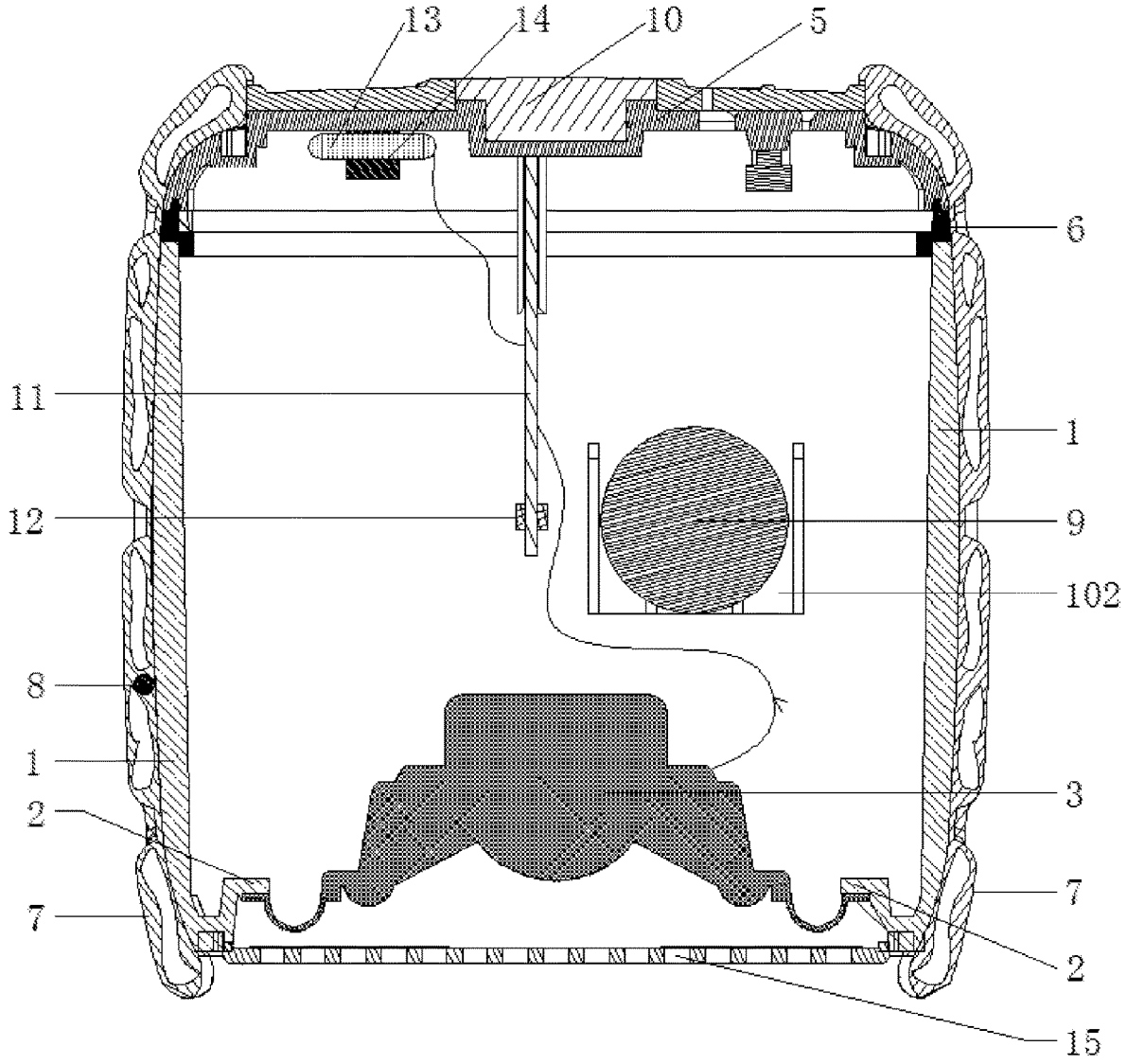
FIG. 2 is a schematic diagram of a semi-sectional structure of the present disclosure.
Figure 3:
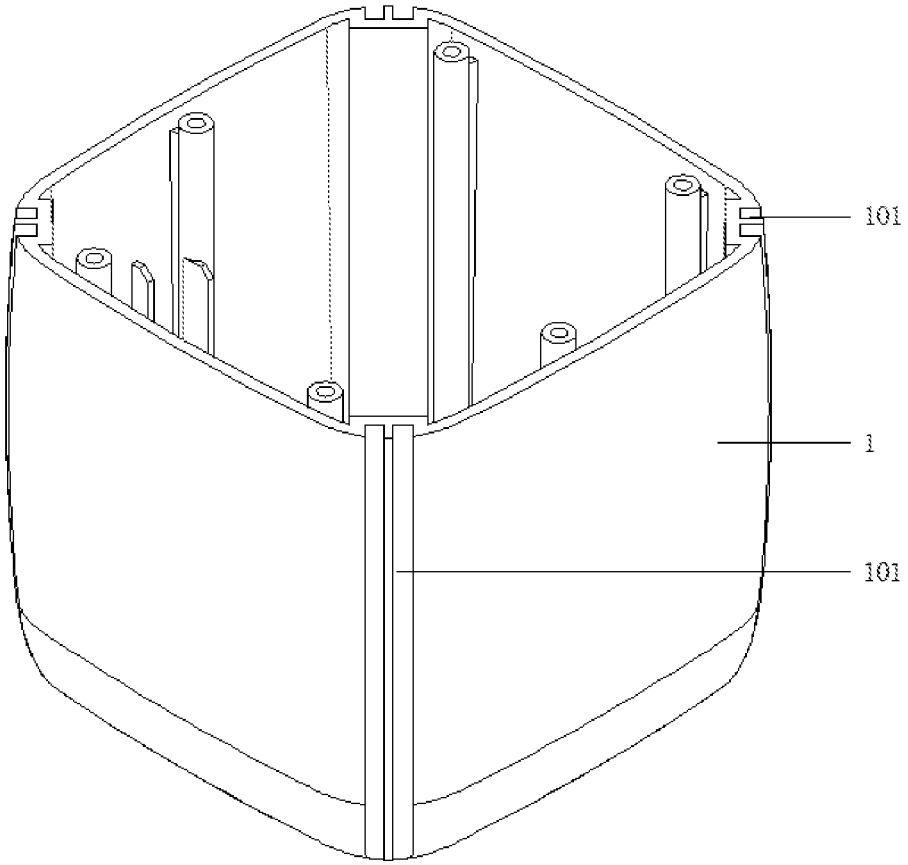
FIG. 3 is a structural schematic diagram of a shell of the present disclosure.

Referring to FIG. 1, FIG. 2, FIG. 3 and FIG. 4, the present disclosure provides a technical scheme: a multifunctional loudspeaker device is provided, as shown in FIG. 1 and FIG. 2, L-shaped mounting parts 2 are arranged at one end of a shell 1, a loudspeaker body 3 is arranged on the L-shaped mounting parts 2, a back cover 5 is arranged at the other end of the shell 1, a sealing rubber ring 6 is arranged between the back cover 5 and the shell 1, double grooves 101 are distributed on the outer side of the shell 1, the shell 1 and a flexible plastic cushion 7 are more firmly arranged via a simple structure, the flexible plastic cushion 7 sleeves the shell 1, the flexible plastic cushion 7 is of a hollow structure and has a shape matching with the exterior of the shell 1, airbags 71 with different sizes are distributed in the body of the flexible plastic cushion 7, air is full of the airbags 71 in order to provide a better buffer effect when the multifunctional loudspeaker device falls off, is impacted or is extruded, an air-pressure probe 8 is also arranged in the body of the flexible plastic cushion 7, and when the multifunctional loudspeaker device falls off, is impacted or is extruded, a balance switch 13 transmits a signal by utilizing the air-pressure probe 8, and then the loudspeaker body 3 may emit a preset sound, such as squeals or ow, and simultaneously emits lights of different modes.

As shown in FIG. 2, an energy storage region 102 is arranged in the shell 1, a lithium battery 9 is arranged in the energy storage region 102, a function button region 501 and a jack 502 are arranged on the outer side of the back cover 5, a sealing rubber plug 10 is arranged in the jack 502 in order to improve the sealing performance of the multifunctional loudspeaker device, a circuit board 11 is arranged on the inner side of the back cover 5, the circuit board 11 is electrically connected with an LED lamp 12, the back cover 5 is further provided with a balance switch 13, the balance switch 13 is detachably mounted on a fixing fastener 14, and the balance switch 13 is electrically connected with the circuit board 11, so the control of signal transmission is more sensitive.

Figure 4:
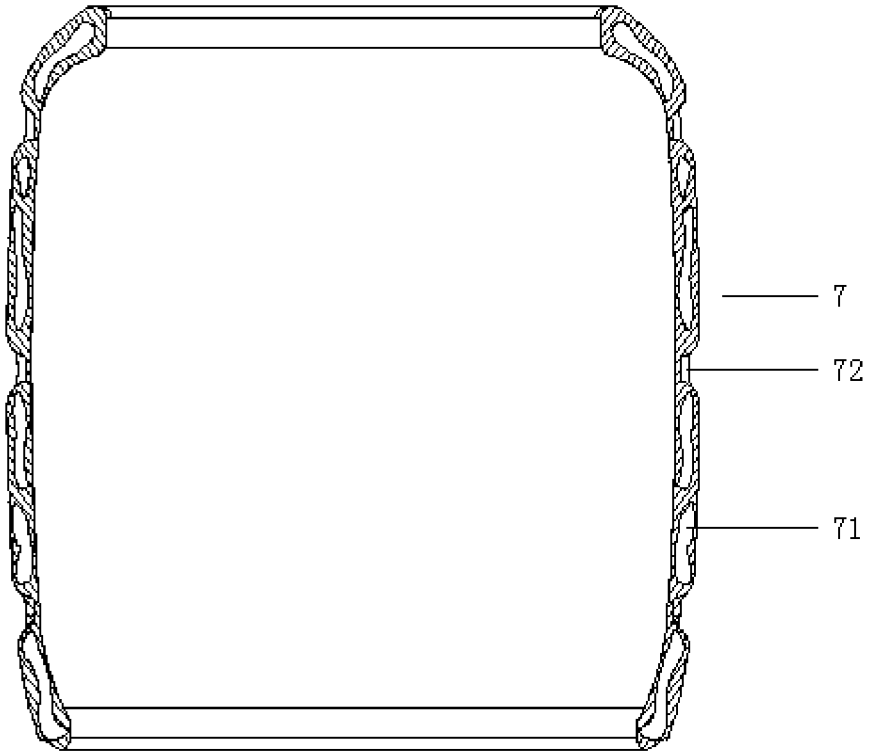
FIG. 4 is a schematic diagram of a semi-sectional structure of a flexible plastic cushion of the present disclosure In the drawings, 1—shell, 101—double groove, 102—energy storage region, 2—L-shaped mounting part, 3—loudspeaker body, 5—back cover, 6—sealing rubber ring, 7—flexible plastic cushion, 71—airbag, 72—groove, 8—air-pressure probe, 9—lithium battery, 10—sealing rubber plug, 11—circuit board, 12—LED lamp, 13—balance switch, 14—fixing fastener and 15—protecting net.

As shown in FIG. 1 or FIG. 4, grooves 72 are formed in the outer side of the flexible plastic cushion 7 so that the multifunctional loudspeaker device is convenient to take up and put down.

Furthermore, a protecting net 15 is laterally arranged on the loudspeaker body 3, and the protecting net 15 is fixed on the shell 1 in order to greatly protect the multifunctional loudspeaker device.

Furthermore, it is noted that, the back cover 5 and the shell 1 are mutually connected, the both are made of a transparent plastic material, and a sealing rubber ring 6 is arranged on the back cover 5 or the shell 1 in order to further improve the sealing performance of the multifunctional loudspeaker device.

To an assembly form of the flexible plastic cushion 7 and the shell 1, the internal volume of the flexible plastic cushion 7 is equal to or smaller than the volume of the shell 1, and an interference fit manner is utilized so that the mounting of the both is firmer, thereby improving the quality of the multifunctional loudspeaker device.

To the multifunctional loudspeaker device, it should be noted that the flexible plastic cushion 7 is made from an elastic material in order to improve the shockproof coefficient of the multifunctional loudspeaker device. It is worth mentioning that the color of a coating or the body of the flexible plastic cushion 7 may adopt a single color or a combination of a plurality of colors.

A layer of the flexible plastic cushion with high buffer coefficient is additionally arranged on the peripheral surface of the multifunctional loudspeaker device so that the shockproof performance of the device is improved; due to a combination of the flexible plastic cushion and the sealing rubber ring, the device may reach the fifth waterproof grade and can float on the water; and when the device falls off, is impacted or is extruded, a signal is transmitted through the balance switch according to response of the air-pressure probe, then the loudspeaker may emit a preset sound and the LED lamp emits lights of different modes at the same time.

Although the embodiments of the present disclosure have been shown and described, it should be understood by those ordinarily skilled in the art that various changes, modifications, substitutions and transformations can be made in the embodiments without departing from the principle and spirit of the present disclosure, and the scope of the present disclosure is defined by the appended claims and their equivalents.

What is claimed is:

1. A multifunctional loudspeaker device, comprising a shell (1), characterized in that: L-shaped mounting parts (2) are arranged at one end of the shell (1), a loudspeaker body (3) is arranged on the L-shaped mounting parts (2), a back cover (5) is arranged at the other end of the shell (1), a sealing rubber ring (6) is arranged between the back cover (5) and the shell (1), double grooves (101) are distributed on the outer side of the shell (1), a flexible plastic cushion (7) sleeves the shell (1), the flexible plastic cushion (7) is of a hollow structure and has a shape matching with the exterior of the shell (1), airbags (71) with different sizes are distributed in the body of the flexible plastic cushion (7), air is full of the airbags (71), and an air-pressure probe (8) is also arranged in the body of the flexible plastic cushion (7).

2. The multifunctional loudspeaker device according to claim 1, characterized in that: an energy storage region (102) is arranged in the shell (1), and a lithium battery (9) is arranged in the energy storage region (102).

3. The multifunctional loudspeaker device according to claim 1, characterized in that: a function button region (501) and a jack (502) are arranged on the outer side of the back cover (5), a sealing rubber plug (10) is arranged in the jack (502), a circuit board (11) is arranged on the inner side of the back cover (5), the circuit board (11) is electrically connected with an LED lamp (12), the back cover (5) is further provided with a balance switch (13), the balance switch (13) is detachably mounted on a fixing fastener (14), and the balance switch (13) is electrically connected with the circuit board (11).

4. The multifunctional loudspeaker device according to claim 1, characterized in that: grooves (72) are formed in the outer side of the flexible plastic cushion (7).

5. The multifunctional loudspeaker device according to claim 1, characterized in that: a protecting net (15) is laterally arranged on the loudspeaker body (3), and the protecting net (15) is fixed on the shell (1).

6. The multifunctional loudspeaker device according to claim 1, characterized in that: the back cover (5) and the shell (1) are mutually connected, and the sealing rubber ring (6) is arranged on the back cover (5) or the shell (1).

7. The multifunctional loudspeaker device according to claim 1, characterized in that: the internal volume of the flexible plastic cushion (7) is equal to or smaller than the volume of the shell (1).

8. The multifunctional loudspeaker device according to claim 7, characterized in that: the flexible plastic cushion (7) is made from an elastic material.

* * * * *